US008192582B2

(12) United States Patent
Chamberland et al.

(10) Patent No.: US 8,192,582 B2
(45) Date of Patent: Jun. 5, 2012

(54) APPARATUS AND METHOD FOR STABILIZING A MOVING WEB

(75) Inventors: Alain Chamberland, Pincourt (CA); Rudy Chang, Lasalle (CA); Joseph Guadagno, Montreal West (CA)

(73) Assignee: Andritz Paper Machinery Ltd., Lachine (CA)

( * ) Notice: Subject to any disclaimer, the term of this patent is extended or adjusted under 35 U.S.C. 154(b) by 21 days.

(21) Appl. No.: 12/813,051

(22) Filed: Jun. 10, 2010

(65) Prior Publication Data

US 2011/0005698 A1 Jan. 13, 2011

Related U.S. Application Data

(60) Provisional application No. 61/224,190, filed on Jul. 9, 2009.

(51) Int. Cl.
*D21F 1/00* (2006.01)

(52) U.S. Cl. ..... 162/295; 162/289; 162/361; 162/202

(58) Field of Classification Search ..... 162/295, 162/289, 361, 202; 226/7, 97.1
See application file for complete search history.

(56) References Cited

U.S. PATENT DOCUMENTS 4,321,107 A 3/1982 Page
5,738,760 A 4/1998 Svanqvist et al.

OTHER PUBLICATIONS

U.S. Appl. No. 12/695,620, Kramer et al., filed Jan. 28, 2010.

*Primary Examiner* — Mark Halpern
(74) *Attorney, Agent, or Firm* — Nixon & Vanderhye P.C.

(57) ABSTRACT

Devices and methods related to a web stabilizer for stabilizing a moving web with a surface adjacent the moving web and with a supply of moving fluid in a direction parallel to the moving web and a supply of moving fluid in a direction perpendicular to the moving web.

10 Claims, 2 Drawing Sheets

APPARATUS AND METHOD FOR STABILIZING A MOVING WEB

RELATED APPLICATION

This application claims priority to U.S. Provisional App. No. 61/224,190, filed on Jul. 9, 2009, the entirety of which is incorporated by reference.

BACKGROUND OF THE INVENTION

Webs of material (including but not limited to tissue, towel, paper, board, plastics, and polymers) are transported through spans that typically have web stabilizers, such as shown in U.S. Pat. No. 4,321,107 and U.S. Pat. No. 5,738,760. The webs move at a relatively high speed through the spans and across the stabilizers.

As the web moves across the flat surface of these stabilizers, the side edges of the web tend to curl. Curling may increase the stresses applied to the web, especially at the web edges. Curling may result in non-uniform stretching of the web across the width of the web and increase the risk of web tearing. The side edges most commonly curl away from the stabilizers due to web tension, gravity, differences in material properties, outside influences such as air currents, and the fact that the material on the web ends is connected to other web material only on one side of the web. There is a need for devices and methods to reduce curling at the side edges of webs.

Other configurations have been proposed, such the one(s) described in U.S. application Ser. No. 12/695,620 filed on Jan. 28, 2010.

BRIEF DESCRIPTION OF THE INVENTION

To minimize web curling, at least two forces are applied: at least one force is applied to the outside sheet edge region of the stabilizer; and at least one force is applied to the main body of the web.

The force is applied to the outside sheet edge region of the stabilizer to draw the side edge of the web to the stabilizer. By drawing the side edge of the web to the stabilizer, the edges of the web are kept in-line with other portions of the web moving across the stabilizer. Minimizing curling of the side edges reduces stresses in the web material, reduces web breaks and may improve characteristics of the web material because the side ends are subjected to less stress and stretching.

The force applied to the outside sheet edge region of the stabilizer may be formed by air movement away from the web edge. For example, compressed air or a vacuum may be applied at or near the sheet edge to draw air from the edge of the web to create a suction pushing the edge of the web towards the stabilizer. To create the suction, air may be forced or drawn through a gap at the sheet edge. The gap is generally parallel to and adjacent the side edge of the web. As the air flows through the gap, a pressure drop forms at the sheet edge that draws the side edge of the web towards the sheet edge of the stabilizer.

To create the force applied to the side edge of the web, the air movement over the sheet edge is preferably in a direction flowing away from the web, perpendicular to the sheet edge, and aligned with the intended elevation of the web. The air movement may be directed in other directions, including towards or away from the stabilizer. The air flow should create a low pressure between the web and the sheet edge of the stabilizer such that the low pressure pulls the side edges of the web towards the sheet edge.

The force is applied to the main body of the web to inhibit the web from fluttering as it passes near the stabilizer. To create the force applied to the side edge of the web, the air movement over the sheet edge is preferably in a direction flowing parallel or substantially parallel with the flow of the web. The air movement may be directed in other directions, so long as some vector of the air flow is concurrent with the direction of web travel. The air flow should create a buffer zone between the web and the stabilizer such that fluttering of the web is inhibited.

DETAILED DESCRIPTION OF THE INVENTION

Figure 1:
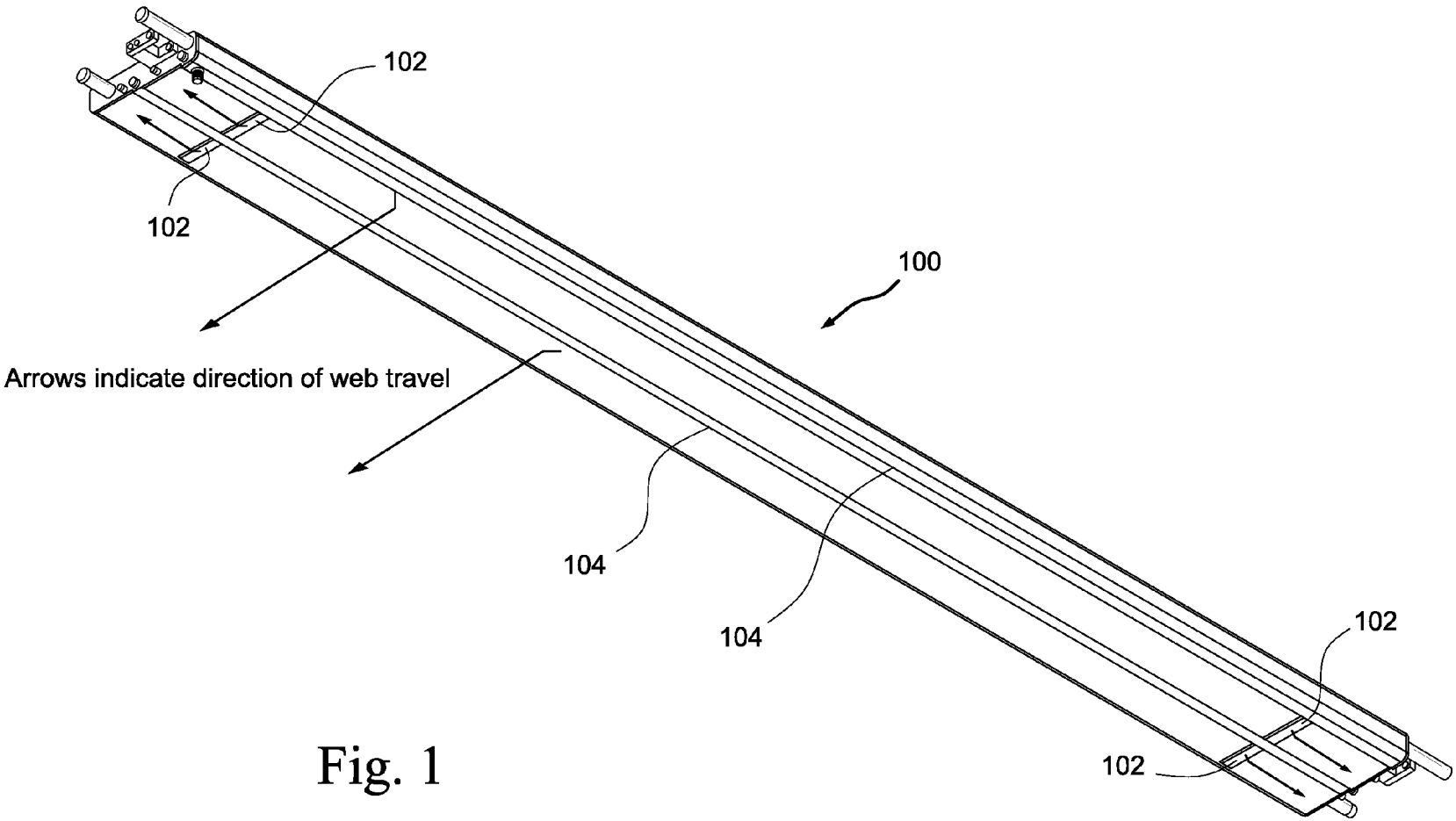
FIG. 1 is a schematic diagram of a web stabilizer in accordance with an aspect of the present invention.
Figure 2:
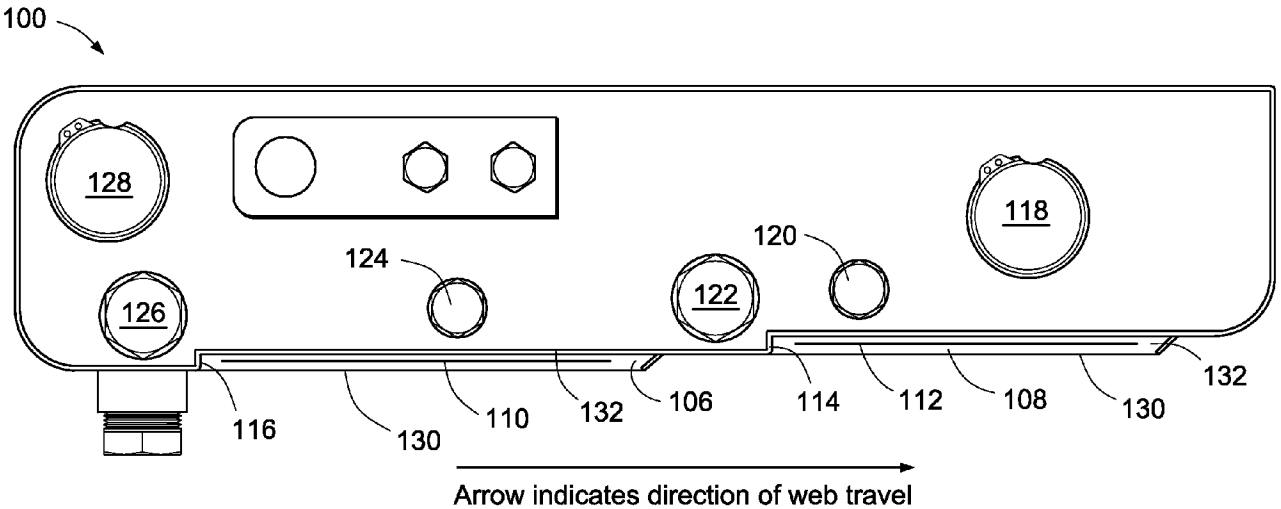
FIG. 2 is a schematic side-view diagram of a web stabilizer in accordance with an aspect of the present invention.
Figure 3:
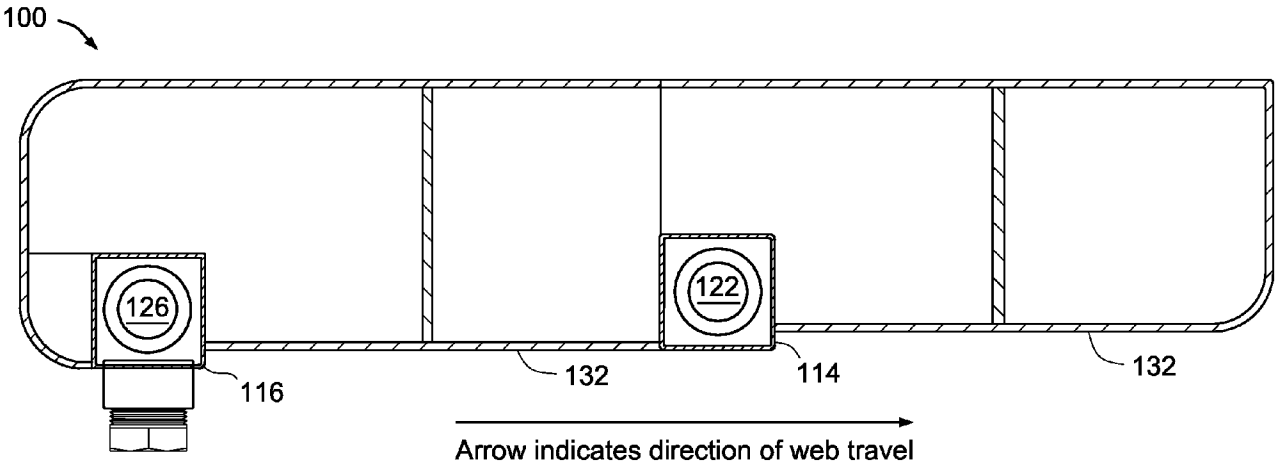
FIG. 3 is a schematic cross-sectional diagram of a web stabilizer in accordance with an aspect of the present invention.

FIGS. 1-3 are schematic diagrams of a web stabilizer 100 and a web moving below the stabilizer. A moving fluid, preferably a gas such as air, is introduced along two portions: substantially widthwise near the outside edge of the web and substantially lengthwise along the stabilizer.

As indicated by the arrows (which indicate the direction of airflow), gaps 102 may introduce air substantially perpendicular to the direction of web travel. Although illustrated as perpendicular to the direction of web travel (i.e., at 90° as measured from the direction of web travel), any suitable angle may be employed. For instance, the "side air" introduced via the gaps 102 at the sides of the web travel may be at any angle between 0 and 90° (such as at substantially 75°) or even any angle at 90°±60° as measured from the direction of web travel.

Similarly as indicated by the arrows (which again indicate the direction of airflow), gaps 104 may introduce air substantially parallel to the direction of web travel (i.e., substantially at 0° as measured from the direction of web travel). Other suitable angles may be employed. For instance, the "step air" may be at any angle ±90° as measured from the direction of air travel.

The stabilizer 100 may be designed to handle any suitable size of web, such as webs that are approximately 212 inches wide. Smaller and larger widths are contemplated, and the precise width of web is relatively unimportant to aspects of the present invention.

The moving fluid (e.g., air) introduced via gaps 102 and gaps 104 create forces that stabilize the web, possibly inhibiting curling and/or fluttering. Reducing curling and/or fluttering should, in many instances, reduce sheet breaks and improve performance and the speed potential of the web machine.

The machine may be employed in a process for making tissue, towel, paper, board, plastics, and/or polymers. It may be possible to use at least certain embodiments in connection with making sheets of malleable metals or other thin films.

The stationary web stabilizer 100 may be a generally rectangular device having a substantially flat bottom surface, as more fully described herein. The web generally moves at a high velocity over the flat bottom surface. The movement of the web creates a pressure difference on opposite sides of the web that draws the web towards the surface. The center portion of the web may be adjacent the bottom of the stabilizer.

The side edges of the web may curl away from the bottom of the stabilizer. There is a desire to eliminate the curling and force the side edge into the same plane as the center portion of the web. Furthermore, there is a desire to simultaneously stabilize the center portion of the web.

To remove the curl of a side edge of the web, a moving fluid, e.g., air, is directed away from the side edge to generate a transverse force applied to the side edge and, at the same time, a moving fluid is directed in the direction of web travel to generate a congruent force applied to the web. The transverse force causes the side edge of the web to move towards the outer edges of the stabilizer, while the congruent force prevents the web from impacting the stabilizer.

The term "air" is used to refer to a moving fluid that is preferably atmospheric air but may be other gases and liquids and includes using vacuum or other negative pressures. In some embodiments, for example, the moving fluid may alternatively comprise inert or substantially inert gasses (e.g., noble gasses, nitrogen, etc.) may be used. And in some embodiments, the moving fluid may facilitate a reaction in or on the web. For instance, the use of oxygen may facilitate an oxidation reaction on the web surface.

The air may flow through any suitable configuration of tubes and/or pipes and may be delivered and/or controlled separately with respect to gaps 102 and 104. In some instances, at least one hollow beam with air nozzles delivers air to gaps 102 and/or 104.

Gaps 102 and/or 104 may include air knives, pipes, beams or bars with internal air passages and air nozzles formed by drilled holes or slots along the length of the device. The devices are preferably mounted on or in the vicinity of a bottom surface of the stabilizer 100 and, particularly, at or outside the sheet edge region of the bottom surface and along the width of the stabilizer 100. Alternatively, the stabilizer may be positioned below the web and have an upper surface adjacent the web, where the air movement device is mounted on top of the upper surface. The surface of the stabilizer adjacent the web may be flat, arched, contoured or have other shape which faces the web.

The air movement through gaps 102 and/or gaps 104 is at a pressure and velocity sufficient to influence the position and orientation of the web edges and web body such that the entire web, including the web's edges, is rendered more stable from the reduced flutter and curl.

The surface of the stabilizer 100 adjacent the web may be smooth or rough, a bottom (or top) surface and a planar surface.

Air through gap 102 may be introduced beyond the web's edge in a horizontal dimension, such in a range of zero to twelve inches from the web edge. The air may be introduced such that the air flows along the surface of the stabilizer. In some embodiments, the air flows away from edge of the web in a direction substantially parallel to the surface of the stabilizer.

FIG. 2 schematically illustrates a side-view of stabilizer 100 showing gaps 106 and 108 for "side air" supplied at least partially perpendicularly to the direction of web travel (as shown by the arrow). The side air stabilizes the edges of the web during operation, and the holes or perforations 110 and 112 in gaps 106 and 108 supply the air in a direction at least partially orthogonal to the side-view depicted (i.e., the air through holes or perforations 110 and 112 are directed partially towards the viewer). Gaps 106 and 108 are defined by the difference in location of surfaces 130 and 132. The web stretches along the width of stabilizer 100 in a plane substantially parallel to surfaces 130 and 132.

As schematically illustrated in the cross-sectional view of FIG. 3, gaps 116 and 114 supply the "step air" in the direction of web travel. Gaps 116 and 114 may be of any suitable height, such as, for example, any height in the range of 1/16" to 3/4" (or greater). These gaps may have a number of holes or perforations that supply air to stabilize the web during operation. For instance, there may be thousands, e.g., about 3600, of perforations for each step. These holes or perforation may each be about 0.001" in diameter or larger (e.g., 0.01").

Although only two gaps are illustrated, alternative embodiments may include a single gap supplying "side air." In addition, other embodiments may include three or more gaps for supplying side air. It may be preferable to have the same number of slots supplying "side air" as supplying "step air".

As illustrated, surfaces 130 and 132 have a stepped configuration, in which the gaps 116 and 114 that supply the "step air" alter the surface of the stabilizer 100. The surfaces 130 and 132 are discontinuous to the direction of the web travel, and the direction of the web travel is substantially parallel to the stepped surfaces 130 and 132.

Shafts 118, 120, 122, 124, 126, and 128 supply a fluid (e.g., air) individually, selectively, and/or collectively to both the gaps for side-air and step-air. These shafts may additionally or alternatively provide mounts for mounting the stabilizer in place. The shafts are connected to gaps 102 and 104 by any suitable equipment, such as, for example, hoses, pipes, etc.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A web stabilizer comprising:

a surface adapted to be adjacent to a moving web of material moving in a web direction, wherein the surface includes a first gap adapted to receive and direct a first moving fluid in a first direction parallel with the web direction and a second gap adapted to receive and direct a second moving fluid in a second direction perpendicular to the web direction, such that the first moving fluid provides a stabilizing congruent force to the moving web and the second moving fluid provides a stabilizing transverse force to the moving web, and wherein the first gap is substantially lengthwise along the web stabilizer, and wherein the second gap is substantially widthwise along the web stabilizer.

2. The web stabilizer in claim 1, wherein the first direction is a direction that is between 0 and 90° as measured from the web direction that is defined by the direction of web travel.

3. The web stabilizer in claim 1, wherein the second direction is a direction that is between 30 and 150° as measured from the web direction that is defined by the direction of web travel.

4. The web stabilizer in claim 1, wherein the second direction is a direction that is between −90 and 90° as measured from the web direction that is defined by the direction of web travel.

5. The web stabilizer of claim 1, wherein the first gap comprises multiple holes, wherein the holes have a diameter of about 0.001 inch to 0.01 inch.

6. The web stabilizer of claim 1, wherein the second gap comprises multiple holes, wherein the holes have a diameter of about 0.001 inch to 0.01 inch.

7. The web stabilizer of claim 1, wherein the first gap has a height between 1/16 inch and 3/4 inch.

8. The web stabilizer of claim 1, wherein the second gap has a height between 1/16 inch and 3/4 inch.

9. The web stabilizer of claim 1 further comprising at least one shaft for supplying the first moving fluid to the first gap and the second moving fluid to the second gap.

10. The web stabilizer of claim 1, wherein the second gap is located near an the outside edge of the web.

* * * * *